US009394596B2

(12) United States Patent
Kramer et al.

(10) Patent No.: US 9,394,596 B2
(45) Date of Patent: Jul. 19, 2016

(54) METHOD TO IMPROVE THE CORROSION RESISTANCE OF ALUMINUM ALLOYS

(75) Inventors: Lawrence S. Kramer, Dayton, MD (US); Catherine Wong, Germantown, MD (US)

(73) Assignee: Concurrent Technologies Corporation, Johnstown, PA (US)

( * ) Notice: Subject to any disclaimer, the term of this patent is extended or adjusted under 35 U.S.C. 154(b) by 172 days.

(21) Appl. No.: 13/416,654

(22) Filed: Mar. 9, 2012

(65) Prior Publication Data

US 2012/0234439 A1 Sep. 20, 2012

Related U.S. Application Data

(60) Provisional application No. 61/454,109, filed on Mar. 18, 2011.

(51) Int. Cl.

| | |
|---|---|
| ***C22F 1/04*** | (2006.01) |
| ***C22F 1/047*** | (2006.01) |
| ***C22F 1/053*** | (2006.01) |

(52) U.S. Cl.

CPC . *C22F 1/047* (2013.01); *C22F 1/04* (2013.01); *C22F 1/053* (2013.01)

(58) Field of Classification Search

CPC ..... C22F 1/04; C22F 1/047; C22C 21/06; C22C 21/00; C22C 21/10; C22C 21/16

USPC ..... 148/688

See application file for complete search history.

(56) References Cited

U.S. PATENT DOCUMENTS 6,248,193 B1 * 6/2001 Zhao et al. ..... 148/693

OTHER PUBLICATIONS

Paglia et al., Scripta Materialia, 2008, vol. 58, p. 383-387.*

ASTM G67-13, ASTM G67 Standard Test Method for Determining the Susceptibility to Intergranular Corrosion of 5XXX Series Aluminum Alloys by Mass Loss After Exposure to Nitric Acid (NAMLT), ASTM International, West Conshohocken, Pa., 1999 www.astm.org.*

* cited by examiner

*Primary Examiner* — Jie Yang

*Assistant Examiner* — Xiaowei Su

(74) *Attorney, Agent, or Firm* — Buchanan Ingersoll & Rooney PC

(57) ABSTRACT

Aluminum-magnesium alloys are ideal for ship construction; however, these alloys can become sensitized and susceptible to intergranular corrosion when exposed to moderately elevated temperatures. A stabilization treatment has been developed to reverse sensitization and restore corrosion resistance, such that in-service plate can be refurbished rather than replaced. This treatment involves a short exposure to a specific elevated temperature range and can be implemented with portable units onboard a ship.

10 Claims, 5 Drawing Sheets

METHOD TO IMPROVE THE CORROSION RESISTANCE OF ALUMINUM ALLOYS

CROSS-REFERENCE TO RELATED APPLICATIONS

This patent application claims priority to U.S. Provisional Patent Application No. 61/454,109, filed on Mar. 18, 2011, which is hereby incorporated by reference herein in its entirety.

STATEMENT REGARDING FEDERALLY SPONSORED RESEARCH/DEVELOPMENT

The present invention was made with government support under contract no. N00178-05-D-4255-FD01 awarded by the Department of Defense. The government has certain rights in the invention.

FIELD OF THE INVENTION

The present inventive disclosure relates toward a method to reverse the sensitization process that causes certain aluminum alloys to become susceptible to corrosion over time, and also toward a method to reverse the sensitization process which allows for continued use of aluminum structures rather than replacement.

BACKGROUND OF THE INVENTION

Aluminum-magnesium, or 5xxx series alloys, have a combination of good strength, weldability, and corrosion resistance that makes them ideal for ship construction and use in marine environments. However, these alloys can become susceptible to intergranular corrosion over their service life. For instance, aluminum alloys with greater than about 3% Mg (including, for example, welded 5456 and 5083 alloys) can be sensitized and become susceptible to intergranular corrosion, and thus cracking, when exposed to elevated temperatures. Thus, such alloys are not considered suitable for service above approximately 65° C.

Aluminum superstructures of, for example, surface ships, have experienced cracking due to the effects of corrosion. The structural 5456 plate, often used for such applications, has become sensitized from long-term exposure to slightly elevated temperatures and perhaps from heat associated with GMA (Gas Metal Arc) welding and, thus, more prone to intergranular corrosion. A sensitized microstructure is one in which the alloying element Mg segregates and forms beta phase precipitates ($Al_3Mg_2$) in a continuous or semi-continuous fashion along the grain boundaries. Thus, sensitization in this case is defined as a microstructure wherein Mg-rich phase precipitates along grain boundaries as $Al_3Mg_2$ (also known as beta phase), in a semi-continuous or continuous fashion or morphology. The beta phase is generally anodic to the grain interiors and brittle and, thus, plates with a sensitized microstructure are susceptible to intergranular corrosion, exfoliation, and stress-corrosion and intergranular cracking when exposed to stress and corrosive media. Once this microstructure is present, corrosion, such as, for example, from salt water, can cause intergranular corrosion and cracking.

Sensitization is not easily reversible, however it may be possible to re-dissolve the beta phase into the alloy matrix via an anneal heat treatment. However, since the 5456 plate derives its strength from work hardening, the annealed plate is softer than, for example, the H116 or H321 marine grade plate. The comparison is a tensile yield strength of approximately 37 ksi for the marine grade plates and 23 ksi for a fully annealed plate. Annealing can, of course, be done partially, and the plate strength can be made to be similar to that of the GMA weld yield strength of approximately 26 ksi.

The problem of intergranular corrosion and cracking gained new attention in 2002 after more than 200 commercial vessels built with 5083-H321 plate were found to be susceptible to intergranular corrosion [see Reference 1]. Many of these vessels required new hulls and superstructures, which led to the adoption of a new ASTM standard B928 [see Reference 2]. This standard required additional certification of aluminum alloy plates for marine use, including the use of the Nitric Acid Mass Loss Test ("NAMLT") [see Reference 3] to better demonstrate corrosion resistance. Nitric acid dissolves the beta phase, thus causing grains surrounded by a relatively continuous network of beta phase to fall out, resulting in significant mass loss from the test sample. Unfortunately, Al—Mg alloy plate samples can pass the B928 requirements and yet, over time, the plate still develops a sensitized microstructure in service, especially in the heat affected zone of a weld [see Reference 4]. That is, at temperatures within the suitable service envelope for these alloys (e.g., below approximately 65° C.) beta phase can still precipitate on grain boundaries over long time periods.

To combat this problem, aluminum companies have tried to apply a stabilization heat treatment to aluminum plates, such that the Mg does precipitate continuously along grain boundaries. For example, during fabrication of 5xxx aluminum plate, rolling is often followed by a stabilization heat treatment. While stabilization often refers to a process developed in order to prevent age-softening, there is another stabilization treatment by which magnesium is precipitated in grain interiors or discontinuously on grain boundaries to reduce the likelihood of future sensitization [see Reference 5]. However, this practice is difficult to apply, and is not always performed correctly (or performed at all), which is evident by the number of problems realized from aluminum ship superstructures. A difficulty further arises in that the proper heat-treatment temperature range is narrow and varies with rolling practice [see Reference 6]. If the plate is treated at a temperature that is too low, beta phase will precipitate on grain boundaries and sensitization will be accelerated. If the stabilization temperature is too high, the Mg will go back into solution in the aluminum matrix, but the strain hardening that Al—Mg alloys rely on for strength will be annealed out and a significant loss in strength will result. In addition, Mg in solution is not stable and may re-precipitate to the grain boundaries over time under the right conditions.

The present inventive disclosure is directed toward overcoming one or more of the above-identified problems.

SUMMARY OF THE INVENTION

In general, the disclosed method is directed toward locally reversing sensitization in 5xxx aluminum plates. This inventive disclosure utilizes a heat treatment analogous to a mill stabilization treatment to reverse sensitization and restore corrosion resistance to existing Al—Mg structures. The method described herein simulates a classical stabilization treatment performed during plate production leading to non-semi-continuous grain-boundary beta phase. The present invention is a method to de-sensitize the plate as an in-situ heat treatment on 5xxx aluminum structures, which can be implemented as an alternative to the costly repair method of cutting out sensitized plate and welding in patches of fresh plate or replacing entire structures altogether.

The disclosed method utilizes a heat treatment practice that effectively dissolves the continuous Mg-rich precipitates on the grain boundaries, thus re-establishing corrosion resistance. The key technical factor for the heat treatment is the establishment of the critical temperature range. At high temperatures, de-sensitization is accomplished by a severe loss in mechanical properties. At lower temperatures, sensitization is accelerated. The disclosed method utilizes a temperature range in which de-sensitization is possible without the degradation of strength.

The other key factor of the disclosed method is that it teaches a method to apply the treatment to shipboard structures (or other structures) in-situ. Several methods with be outlined, including the use of heat blankets, heat guns and other heating methods. The technical factor that makes the in-situ application of the heat treatment work is the short exposure time. The longer the exposure time, the more the adjacent, unheated plate will be affected. This adjacent plate heating will be at a lower temperature than the applied heating and, thus, likely in the range of temperatures that causes and accelerates sensitization in the first place. So, the disclosed method allows the use of a de-sensitization treatment without the likelihood of collateral damage to non-treated areas of the structure. The disclosed method can utilize virtually any kind of portable heat application and method to control the heat applied to a complex aluminum structure.

Since large structures cannot typically be removed and furnace treated as a unit, the stabilization treatment must often be performed via a portable heat unit. In one embodiment of this invention, a flexible ceramic pad heater is used to treat a vertical 5456 panel. Since the panel may be larger than the heat source used, the heat source typically has to be moved around the panel to treat the entire surface. This process causes the plate adjacent to the heat source to experience some intermediate level of heating. However, if the entire panel is ultimately treated, this nuisance heating will eventually be on fully-stabilized plate.

The present invention provides the ability to effectively reverse the sensitization of 5xxx aluminum alloys and, thus, enable affected structures to be reconditioned rather than scrapped. Sensitization has been observed in plate material at lower operating temperatures than previously thought sufficient to induce sensitization, and also in plate that had been previously certified to the ASTM B928 standard. Thus, it is important to monitor the progress of sensitization on structures, especially welded ones, before the onset of intergranular corrosion and cracking. Previously, sensitized plate was typically allowed to continue in service until cracking occurred, and then it was removed and a new plate was patched in by welding.

An alternative method that reverses sensitization and prevents cracking is possible with the application of the methods of the present invention and enables an extension of service life with lower maintenance costs. In a preferred embodiment, a stabilization treatment on sensitized plate is effective with an exposure time as short as, for example, 10 minutes at temperatures from approximately 240° C. to 280° C. This short elevated temperature treatment allows for implementation by means of portable heating units. In another embodiment, automatic methods including, for example, robotic manipulation of heater units can be utilized.

In another embodiment, substructures are subjected to the method(s) of the present invention in a furnace. Other means of providing the method taught by this invention includes the application of localized heat via heating blankets, flexible polymeric heat pads, high intensity lights, induction heating, or any other method that provides for suitable, controllable heat. The examples described herein mainly pertain to aluminum plate, but the present invention is also suitable for other product forms including, but not limited to, extruded profiles, castings, forgings and weldments.

In one embodiment of the present invention, a method of stabilization of aluminum alloy objects is provided, which includes exposing an aluminum alloy structure to an elevated temperature for a short period of time. In one form, the aluminum alloy is of the 5xxx alloy type, or aluminum primarily alloyed with magnesium. In another form, the aluminum alloy is of the 7xxx alloy type, or aluminum primarily alloyed with zinc and magnesium. The elevated temperature can range from about 225° C. to about 280° C. The short period of time can range from approximately 5 to 60 minutes. However, other temperatures and time periods are contemplated.

In one form, the exposure to elevated temperature is accomplished via the application of a portable heating unit. In another form, the exposure to elevated temperature is performed in a furnace. The aluminum object can include, for example, a structure, plate, extruded profile, casting, forging or weldment.

In a further embodiment, a method of stabilization of a sensitized aluminum-magnesium alloy structure is provided, which includes applying a short elevated temperature exposure to the aluminum-magnesium alloy structure by using a portable heating device such that large structures can be treated one area at a time. In one form, the sensitized alloy exhibits a NAMLT test result of greater than 25 mg/cm$^2$, and wherein said exposure results in an alloy that is resistant to intergranular corrosion as measured by a NAMLT test result of fewer than 25 mg/cm$^2$. In another form, the sensitized alloy exhibits a NAMLT test result of greater than 25 mg/cm$^2$, and wherein said exposure results in an alloy that is resistant to intergranular corrosion as measured by a NAMLT test result of less than 15 mg/cm$^2$.

It is preferred that the hardness of the stabilized alloy is not decreased by more than 50% as measured by the change in Rockwell B hardness values. It is more preferred that the hardness of the stabilized alloy is not decreased by more than 25% as measured by the change in Rockwell B hardness values.

In one form, the structure is on board a ship. Alternately, the structure can be the hull of a ship. The portable heating device may include ceramic or polymeric pad heaters configured for hand held use. Alternately, the portable heating device may be configured for automated or robotic use. Additionally, the portable heating device may be fabricated from heating blankets, high intensity lights or an induction heat unit.

In a further embodiment, a method of stabilization of a sensitized aluminum-magnesium alloy structure is providing, which includes applying a short elevated temperature exposure to a sensitized portion of the aluminum-magnesium alloy structure in-situ while the sensitized portion remains integral with the aluminum-magnesium alloy structure. In one form, a portable heating device is used to apply the short elevated temperature exposure to the sensitized portion of the aluminum-magnesium alloy structure in-situ.

Other objects, aspects and advantages of the present invention can be obtained from a study of the specification, the drawings, and the appended claims.

DETAILED DESCRIPTION OF THE INVENTION

Figure 1:
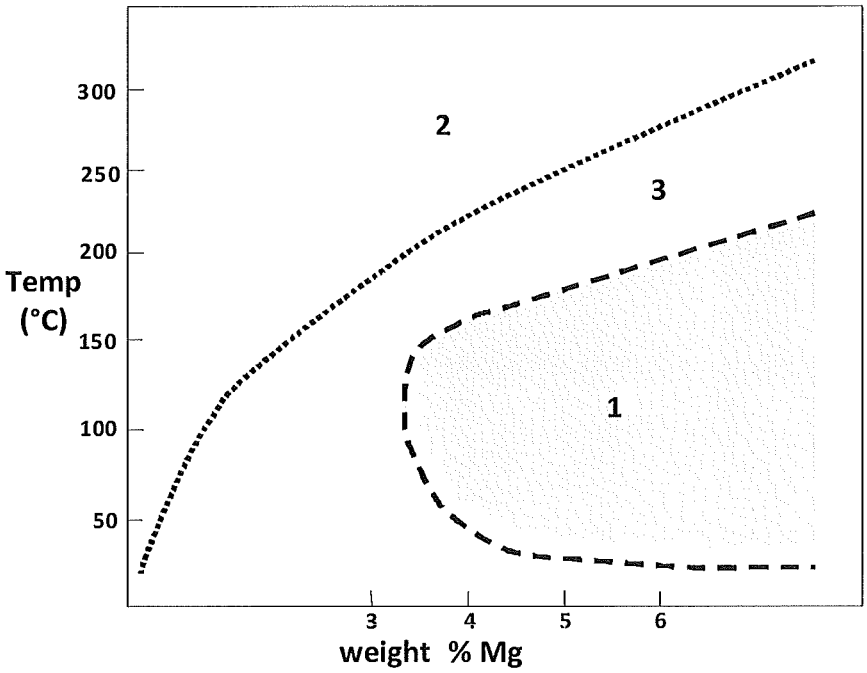
FIG. 1 is a Schematic of the Effect of Temperature on Al—Mg Alloys (adapted from [References 6 and 7])

A schematic of the stabilization temperature range for Al—Mg alloys is shown in FIG. 1. Alloys, such as, for example, 5083 (4.5 Mg) and 5456 (5.1 Mg) can become sensitized and, thus, corrosion susceptible, upon exposure to the temperature range depicted by the shaded area 1. FIG. 1 is a schematic and shows that additional factors are also important in defining the various regions for a given plate. These factors include, for example, the exposure time at a given temperature, the extent of recrystallization, and the amount of cold work applied during fabrication. FIG. 1 also shows that these alloys can be annealed at temperatures above the beta phase solid solubility limit, at region 2. In between these two regions 1 and 2 is the stabilization range 3 wherein beta phase can be redistributed, such that it is not continuous along grain boundaries while avoiding softening the plate.

Figure 2:
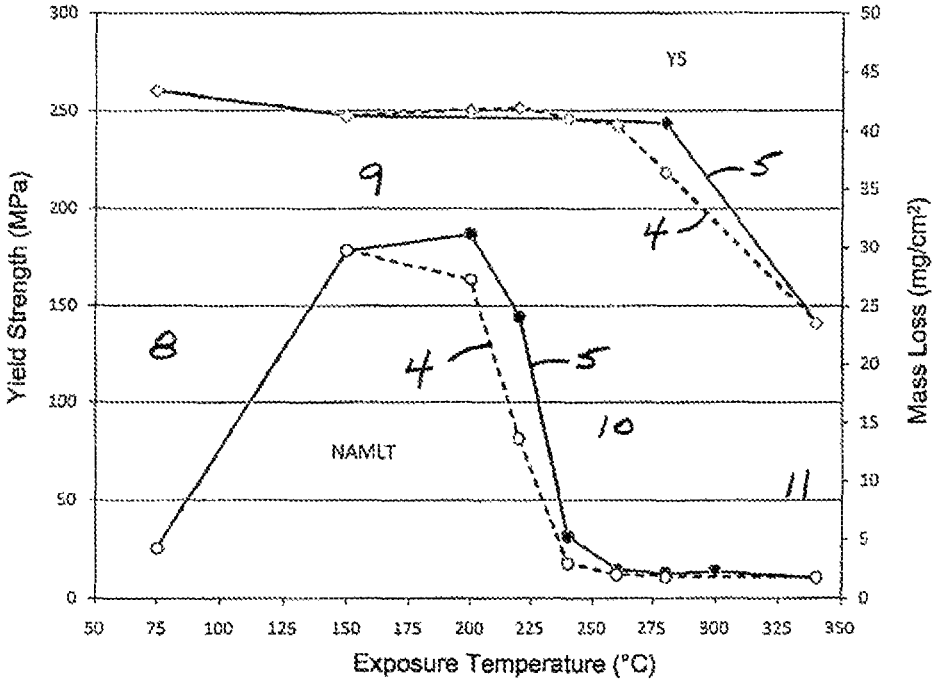
FIG. 2 is a chart of NAMLT Results of 5456-H116 Plate after Progressive Elevated Temperature Exposures.

FIG. 2 shows responses of a 5456 plate to elevated temperature exposure. A 10 minute exposure 4 (shown in dotted lines) and a 30 minute exposure 5 (shown in solid lines) are both shown. The lower curve represents NAMLT values, and the upper curve shows Yield Strength (YS) test results. The top curve (YS) is a measure of Yield Strength (MPa) (the legend on the left) vs. Exposure Temperature (° C.). The bottom curve is a measure of Mass Loss (mg/cm$^2$) (the legend on the right) vs. Exposure Temperature (° C.). The left side of the chart shows the initial H116 condition (at region 8), followed by a sensitized condition (at region 9), and then a region where the plate has been de-sensitized (at region 10). The far right also represents a de-sensitized condition (at region 11), although specimens subjected to these conditions have become annealed with a resultant significant loss of strength. These curves show that a sensitization treatment and a stabilization treatment below around 300° C. does not significantly affect strength. The sensitization treatment applied is shown to effectively give NAMLT results above 25 mg/cm$^2$, and stabilization treatments that reduce NAMLT to below 15 mg/cm$^2$ need to be performed at temperatures greater than approximately 230° C. While an effective stabilization temperature may be slightly lower for longer exposure times (e.g., 30 minutes vs. 10 minutes) a reasonable temperature range appears to be from 240° C. to 280° C. The plate will remain sensitized below this range while the yield strength significantly declines above this range.

Figure 3:
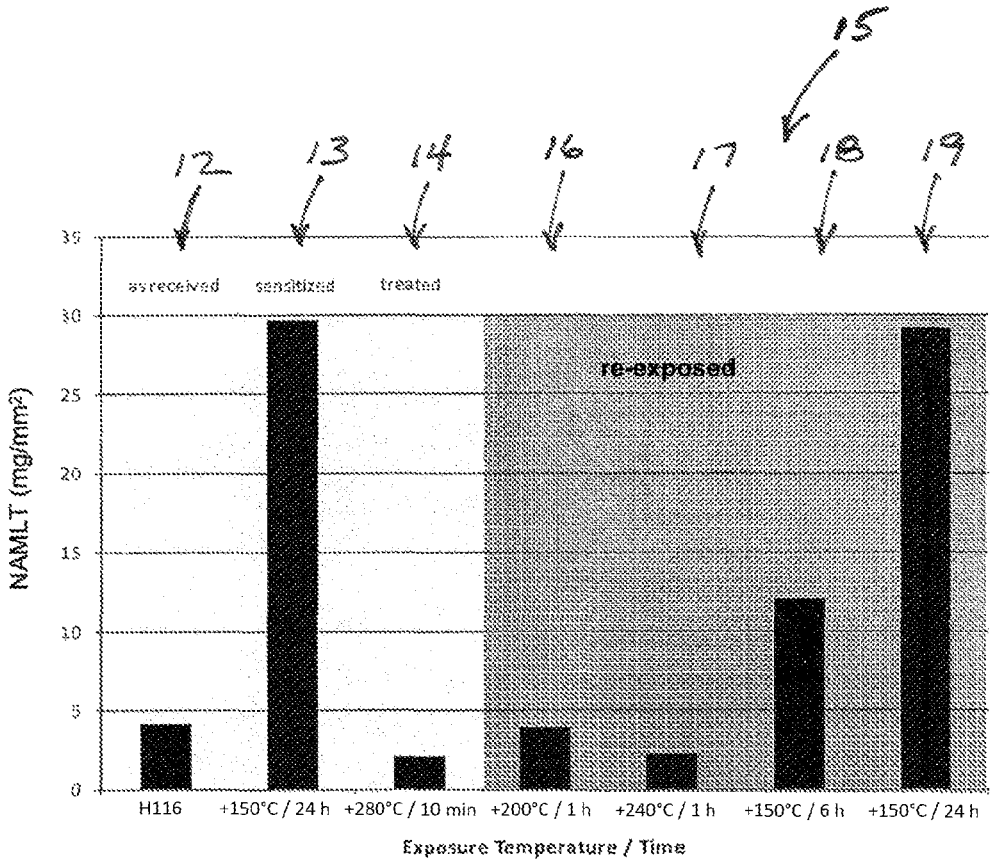
FIG. 3 is a chart of NAMLT and Yield Strength for Treatment vs. Temperature in 5456 Plate.

To determine if the stabilized plate would become re-sensitized, additional tests were performed. FIG. 3 is a bar graph of NAMLT (mg/mm$^2$) vs. Exposure Temperature/Time. FIG. 3 shows the sensitization cycle of an as-received 5456-H116 plate (as shown at 12), that is intentionally sensitized (as shown at 13), treated to become stabilized (as shown at 14), and then exposed again (as shown generally at 15) to an elevated temperature to determine if the plate would re-sensitize. FIG. 3 illustrates that exposure times of 1 hour at 200° C. (as shown at 16) and 240° C. (as shown at 17) temperatures, which may represent the nuisance heat experienced by plate adjacent to areas being treated, do not significantly increase corrosion susceptibility. However, an exposure of 6 hours at 150° C. (as shown at 18) will increase the corrosion susceptibility somewhat, although the plate remains below the ASTM B928 limit of 15 mg/cm$^2$. An aggressive 24-hour treatment at 150° C. (as shown at 19) (e.g., the same cycle as the initial sensitization treatment) will result in the plate being sensitized as it did for the as-received plate. In general, it appears that the treatment given has restored the sensitized plate to near its original condition. This does not make the plate impervious to sensitization, but resets the starting point so that its service life is effectively extended.

EXAMPLE

Table 1 below shows the tensile test results from 5456-H116 plate in the as-received, sensitized, and sensitized and subsequently processed conditions. The sensitization treatment was a 24 hour hold at 150° C. As shown in the metallography FIGS. 4-7, the sensitization treatment increases the continuous beta-phase on the grain boundaries, resulting in a high weight loss during the NAMLT (Nitric Acid Mass Loss, ASTM G67) corrosion test (see Table 1).

At first, a 340° C. heat treatment was applied, and while it cleaned up the grain boundaries and reduced the NAMLT weight loss, it also reduced the strength of the plate significantly. Table 1 shows the values for application of 340° C. for 1 hour, 4 hour, 12 hour and 24 hour time periods. Thus, while this showed promise, the yield strength (YS) was reduced below the general threshold of 26 ksi. Next, a 240° C. heat treatment was utilized to try and mimic a practice that has been used in a so-called stabilization heat treatment by aluminum rolling mills. Table 1 shows the values for application of 240° C. for 0.5 hour, 1 hour and 4 hour time periods. This type of heat treatment is not always applied, or applied correctly, and the exact time and temperature of such a treatment varies with alloy composition and rolling practice and, thus, is somewhat of a lost art. However, this type of heat treatment had historically been used for freshly rolled plate to prevent sensitization and not for plate already sensitized. The 240° C. heat treatment was found to clean up the grain boundaries, reduce the NAMLT weight loss, and maintain a high yield strength, as shown in Table 1 and the metallography in FIGS. 4-7.

Figure 4:
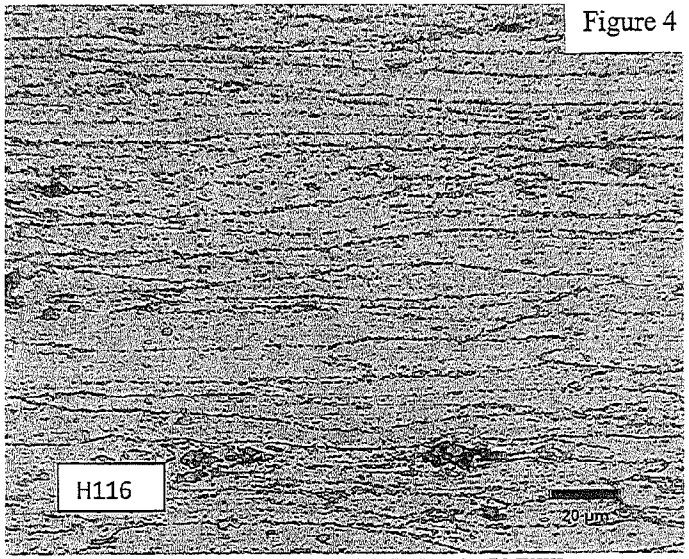
FIGS. 4-7 are Metallography graphs having the properties: L-ST orientation at T/2; Etch: 3 minutes in 40% phosphoric acid @ 95° F. (35° C.)
Figure 5:
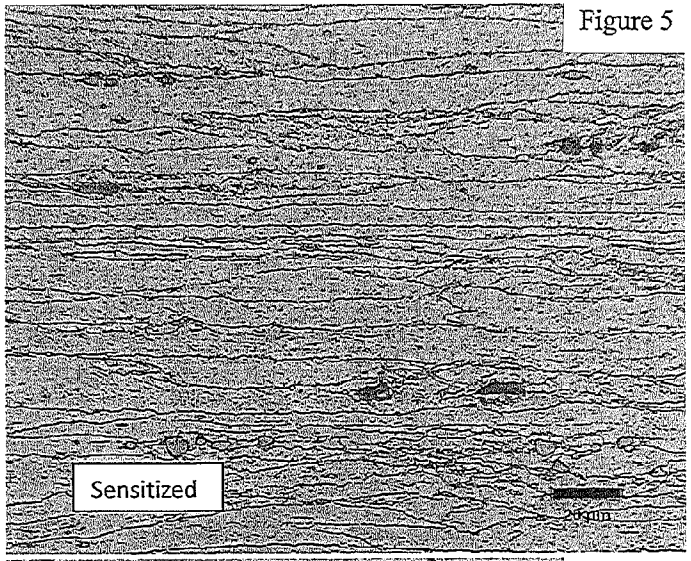
Figure 6:
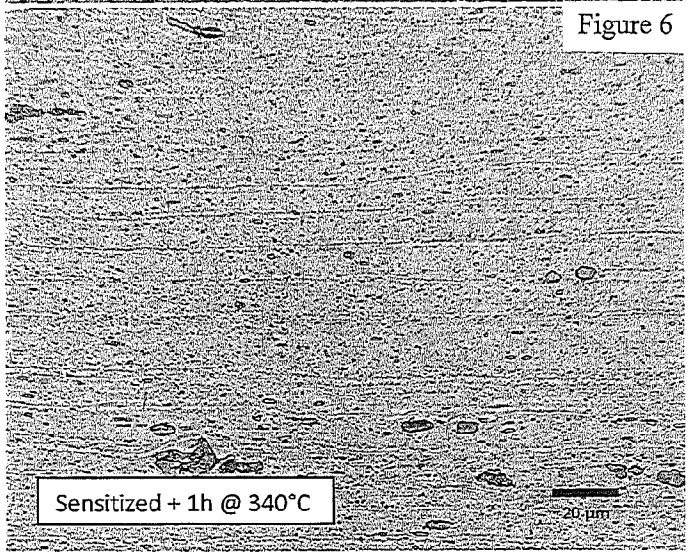
Figure 7:
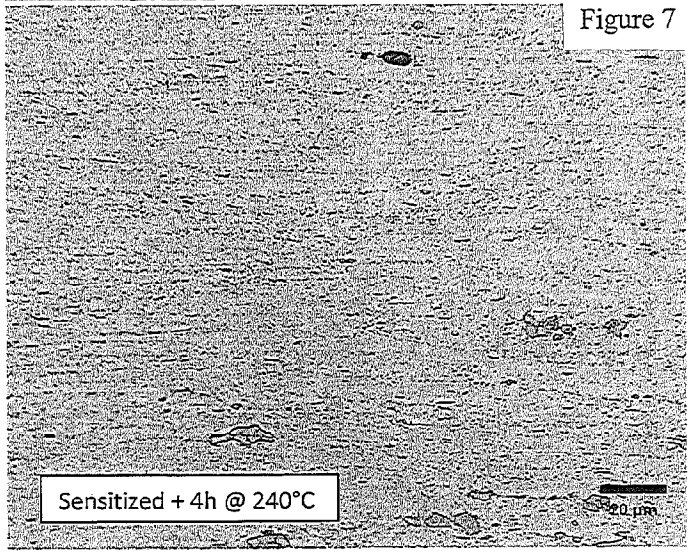

As shown in FIGS. 4-5, optical metallography confirms that the sensitization treatment did result in a semi-continuous network of grain boundary beta phase, as expected from the NAMLT results. After a 340° C. treatment, the sensitized specimens revert back to a low NAMLT test value, but the resultant low strength indicates that annealing occurred. Optical metallography confirmed that after 24 hours at 340° C. the grain boundary beta has gone back into solution (see FIG. 6). However, as expected from the NAMLT results, a treatment of 10 minutes at 240° C. also effectively dissolves the grain boundary beta phase (see FIG. 7), although without the softening due to significant annealing.

TABLE 1

5456 Tensile results, LT, mean of 3

| Condition | | Heat treat | UTS (ksi) | YS (ksi) | El (%) | NAMLT (mg/cm$^2$) |
|---|---|---|---|---|---|---|
| H116 | As-received | | 55.0 | 38.2 | 20.8 | 3.8 |
| Sensitized | 24 h @ 150° C. | | 54.0 | 35.9 | 22.8 | 30.3 |
| Sensitized + | 24 h @ 150° C. + | 1 h @ 340° C. | 47.5 | 20.4 | 26.3 | 1.7 |
| | | 4 h @ 340° C. | 47.1 | 20.2 | 28.2 | 1.8 |
| | | 12 h @ 340° C. | 47.3 | 20.5 | 28.2 | 1.9 |
| | | 24 h @ 340° C. | 47.2 | 20.6 | 28.2 | 1.8 |
| Sensitized | 24 h @ 150° C. | | 53.4 | 35.5 | 20.0 | 29.7 |
| Sensitized + | 24 h @ 150° C. + | 0.5 h @ 240° C. | 53.3 | 35.8 | 20.7 | 3.0 |
| | | 1 h @ 240° C. | 53.2 | 35.6 | 21.5 | 3.9 |
| | | 4 h @ 240° C. | 52.4 | 34.9 | 19.8 | 2.7 |

Metallography (FIGS. 4-7): L-ST orientation at T/2.
Etch: 3 minutes in 40% phosphoric acid @ 95° F. [35° C.]

Figure 8:
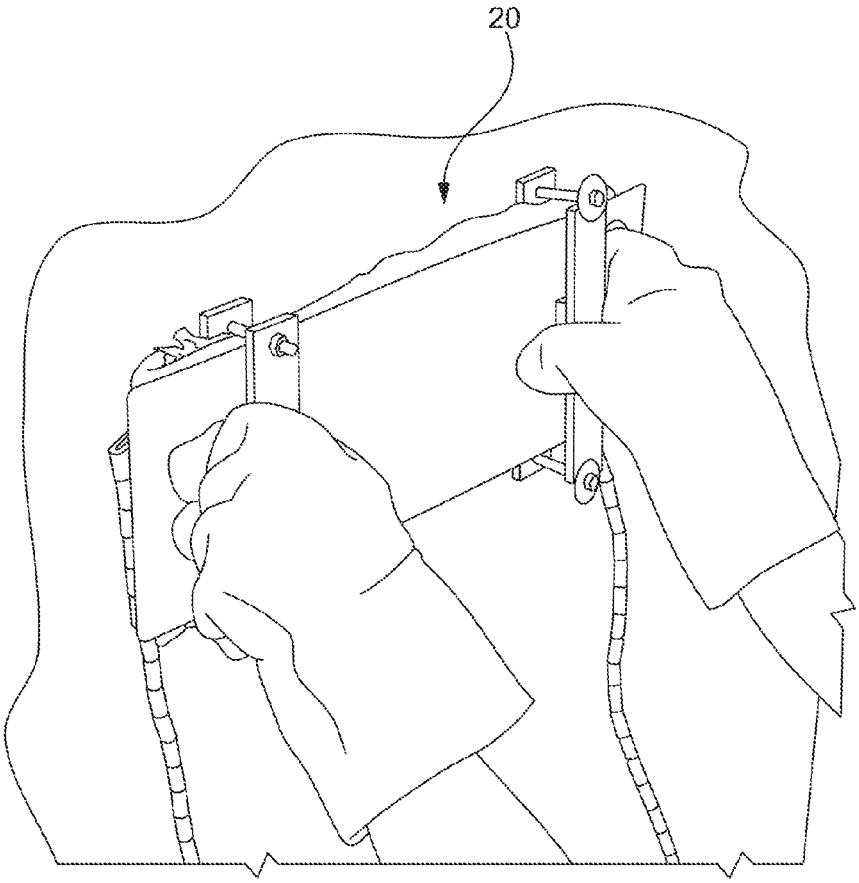
FIG. 8 is an illustration of an exemplary portable heating unit being used to heat a panel in accordance with the inventive method.

As noted previously, application of the heat may be implemented via portable heaters. This has particular utility when stabilization treatments are provided to large structures, such as, for ship superstructures. Since these large structures cannot typically be removed and furnace treated as a unit, the stabilization treatment must often be performed via a portable heat unit. In one exemplary embodiment of this invention, as shown in FIG. 8, a flexible ceramic pad heater 20 is used as a heat source to treat a vertical 5456 panel. Since the panel may typically be larger than the heat source used, the heat source must be moved around the panel to treat the entire surface. While this process will cause the plate adjacent to the heat source to experience some intermediate level of heating, if the entire panel is ultimately treated, this nuisance heating will eventually be on fully-stabilized plate.

It will be apparent to those skilled in the art that numerous modifications and variations of the described examples and embodiments are possible in light of the above teachings of the disclosure. The disclosed examples and embodiments are presented for purposes of illustration only. Therefore, it is the intent to cover all such modifications and alternate embodiments as may come within the true scope of this invention, which is to be given the full breadth thereof. Additionally, the disclosure of a range of values is a disclosure of every numerical value within that range.

All of the Reference cited below are incorporated herein by reference in their entireties.

REFERENCES

1. H. Bushfield, M. Cruder, R. Farley, J. Towers, "Marine Aluminum Plate—ASTM Standard Specification B 928 and the Events Leading to Its Adoption," Presented at the October 2003 Meeting of the Society of Naval Architects and Marine Engineers, San Francisco, Calif.
2. ASTM B928 Standard Specification for High Magnesium Aluminum-Alloy Sheet and Plate for Marine Service and Similar Environments, ASTM International, West Conshohocken, Pa., 2007, www.astm.org.
3. ASTM G67 Standard Test Method for Determining the Susceptibility to Intergranular Corrosion of 5XXX Series Aluminum Alloys by Mass Loss After Exposure to Nitric Acid (NAMLT), ASTM International, West Conshohocken, Pa., 1999 www.astm.org.
4. R. A. Sielski, "Research Needs in Aluminum Structure," 10th International Symposium on Practical Design of Ships and Other Floating Structures, Houston, Tex., 2007, American Bureau of Shipping.
5. R. E. Sanders Jr., P. A. Hollinshead, E. A. Simielli, "Industrial Development of Non-Heat Treatable Aluminum Alloys," MATERIALS FORUM, VOLUME 28—Published 2004, Edited by J. F. Nie, A. J. Morton, B. C. Muddle, Institute of Materials Engineering Australasia, Ltd.
6. E. H. Dix, Jr., W. A. Andersen, M. B. Shumaker, "Influence of Service Temperature on the Resistance of Wrought Aluminum-Magnesium Alloys to Corrosion," CORROSION, Vol. 15, No. 2, pp. 55t-62t, February 1959.
7. G. Scamans, "Stabilisation of AA5xxx Alloys," Innoval Technology Limited, Commercial Report IR08-042, May 2008.
8. W. Golumbfskie, C. Wong, "Investigation of 5xxx Aluminum Sensitization Based Upon Thermal Loading," Presented at ShipTech 2010, March 2010, Biloxi, Mass.

We claim:

1. A method of desensitizing a sensitized portion of an aluminum-magnesium alloy structure to restore corrosion resistance, the method comprising the steps of:

detecting that a localized portion of the aluminum-magnesium alloy structure has become sensitized due to exposure to elevated temperatures after being processed into a finished product, wherein the finished product initially had an original state that was not sensitized, wherein the detected localized portion includes magnesium-rich precipitates existing along grain boundaries, and wherein the detected localized portion exhibits a ASTM G67 Standard Nitric Acid Mass Lost Test (NAMLT) result of greater than 25 mg/cm$^2$; and applying heat to the detected localized portion at a temperature of 225° C. to 280° C. for a period of 5 to 60 minutes, wherein the application of heat to the detected localized portion dissolves the magnesium-rich precipitates existing along the grain boundaries back into solution and desensitizes the detected localized portion to re-establish corrosion resistance to produce a stabilized aluminum-magnesium alloy structure at the detected localized portion, resulting in the aluminum-magnesium alloy structure of at least the detected localized portion being resistant to intergranular corrosion, wherein said heating step results in the detected localized portion being resistant to intergranular corrosion and the NAMLT result of the detected localized portion after the heating step is fewer than 25 mg/cm$^2$, wherein the heat is applied to the detected localized portion in-situ via a portable heating device while the detected localized portion remains integral with the aluminum-magnesium alloy structure of the finished product, and wherein the aluminum-magnesium alloy structure is of the 5xxx alloy, or other aluminum primarily alloyed with magnesium.

2. The method of claim 1, wherein the detecting step further comprises determining that magnesium has segregated and that magnesium has formed beta phase precipitates along the grain boundaries at the detected localized portion.

3. The method of claim 1, wherein the heating step results in the detected localized portion being resistant to intergranular corrosion and the NAMLT result of the detected localized portion after the heating step is fewer than 15 $mg/cm^2$.

4. The method of claim 1, wherein the hardness of the stabilized aluminum-magnesium alloy is not decreased by more than 50% as measured by the change in Rockwell B hardness values.

5. The method of claim 1, wherein the hardness of the stabilized aluminum-magnesium alloy is not decreased by more than 25% as measured by the change in Rockwell B hardness values.

6. The method of claim 1, wherein said structure is on board a ship.

7. The method of claim 1, wherein said structure comprises a hull of a ship.

8. The method of claim 1, wherein said portable heating device is comprised of ceramic or polymeric pad heaters configured for hand held use.

9. The method of claim 1, wherein said portable heating device is configured for automated or robotic use.

10. The method of claim 1, wherein said portable heating device is fabricated from heating blankets, high intensity lights, electric resistance heating or an induction heat unit.

* * * * *